US006575823B1

(12) United States Patent
Obeng et al.

(10) Patent No.: US 6,575,823 B1
(45) Date of Patent: Jun. 10, 2003

(54) POLISHING PAD AND METHOD FOR IN SITU DELIVERY OF CHEMICAL MECHANICAL POLISHING SLURRY MODIFIERS AND APPLICATIONS THEREOF

(75) Inventors: Yaw S. Obeng, Orlando, FL (US); Edward M. Yokley, Penbroke Pines, FL (US)

(73) Assignee: PsiloQuest Inc., Orlando, FL (US)

( * ) Notice: Subject to any disclaimer, the term of this patent is extended or adjusted under 35 U.S.C. 154(b) by 0 days.

(21) Appl. No.: 10/077,709

(22) Filed: Mar. 4, 2002

Related U.S. Application Data

(60) Provisional application No. 60/273,685, filed on Mar. 6, 2001.

(51) Int. Cl.[7] ..... B24D 3/28

(52) U.S. Cl. ..... 451/526; 451/285; 451/36; 451/41

(58) Field of Search ..... 451/526, 285–288, 451/36, 37, 41, 56, 57, 60, 64, 65; 156/345.1, 345.11, 345.12; 51/300

(56) References Cited

U.S. PATENT DOCUMENTS

| | | | | |
|---|---|---|---|---|
| 4,613,345 | A | 9/1986 | Thicke et al. | 51/293 |
| 5,624,303 | A | 4/1997 | Robinson | 451/285 |
| 6,048,256 | A | 4/2000 | Obeng et al. | 451/60 |
| 6,063,306 | A | 5/2000 | Kaufman et al. | 252/79.4 |
| 6,099,954 | A | 8/2000 | Urbanavage et al. | 428/314.2 |
| 6,132,298 | A | 10/2000 | Zunigna et al. | 451/288 |
| 6,267,644 | B1 | 7/2001 | Molnar | 451/41 |
| 6,283,829 | B1 | 9/2001 | Molnar | 451/8 |
| 6,291,349 | B1 | 9/2001 | Molnar | 438/690 |
| 6,293,851 | B1 | 9/2001 | Molnar | 451/41 |
| 6,328,634 | B1 | 12/2001 | Shen et al. | 451/41 |
| 6,346,202 | B1 | 2/2002 | Molnar | 216/88 |
| 6,354,915 | B1 | 3/2002 | James et al. | 451/41 |
| 6,413,153 | B1 | 7/2002 | Molnar | 451/259 |
| 6,428,388 | B2 | 8/2002 | Molnar | 451/8 |
| 6,435,948 | B1 | 8/2002 | Molnar | 451/41 |

FOREIGN PATENT DOCUMENTS

| | | |
|---|---|---|
| JP | 01 064776 | 3/1989 |
| JP | 08 078369 | 3/1996 |
| JP | 9132661 | 5/1997 |
| JP | 11 245164 | 9/1999 |
| WO | WO 99/10129 | 3/1999 |
| WO | WO 9962673 | 12/1999 |

*Primary Examiner*—Joseph J. Hail, III
*Assistant Examiner*—David B. Thomas
(74) *Attorney, Agent, or Firm*—Hitt Gaines & Boisbrun, PC

(57) ABSTRACT

The present invention is directed, in general, to polishing pads for chemical mechanical polishing of semiconductor wafers and integrated circuits. More specifically, the invention is directed to polishing pads containing a precursor slurry modifier. In the presence of a polishing slurry during chemical mechanical polishing, the precursor is released to the polishing slurry to form a slurry modifier thereby improving polishing.

31 Claims, 4 Drawing Sheets

POLISHING PAD AND METHOD FOR IN SITU DELIVERY OF CHEMICAL MECHANICAL POLISHING SLURRY MODIFIERS AND APPLICATIONS THEREOF

CROSS-REFERENCE TO PROVISIONAL APPLICATION

This application claims the benefit of U.S. Provisional Application No. 60/273,685 filed, entitled "Polishing Pad composition and Method of Use," to Yaw S. Obeng, et al., filed on Mar. 6, 2001, which is commonly assigned with the present invention and incorporated herein by reference as if reproduced herein in its entirety.

TECHNICAL FIELD OF THE INVENTION

The present invention is directed, in general to polishing pads for chemical mechanical polishing of semiconductor wafers and integrated circuits. More specifically, the invention is directed to a polishing pad and method for the in situ delivery of slurry modifiers and a polishing apparatus incorporating the present invention.

BACKGROUND OF THE INVENTION

Chemical-mechanical polishing (CMP) is a popular planarizing technique in the manufacture of VLSI integrated circuits. Although it has potential for planarizing a variety of materials in IC processing, CMP is used most widely for planarizing metallization layers and interlevel dielectrics on semiconductor wafers, and for planarizing substrates for shallow trench isolation.

The success of CMP over other methods, such as etchback, is due to the higher degree of wafer planarity achievable with the CMP technique, as ever-increasing needs for miniaturization in electronic devices require tighter wafer planarity tolerances. In CMP, a semiconductor wafer is polished using a repetitive, regular motion of a mechanical polishing wheel and a slurry which may contain a mixture of fine particles and chemical etchants. By placing the slurry between the polishing wheel and the wafer, material may be removed with a high degree of planarity. To aid in the planarization process, the polishing wheel commonly employs a specialized polishing pad that may be made from felted or woven natural fibers such as wool, or various type of synthetic thermoset polymers, such as urethane-impregnated felted polyester or polyurethane.

There are three critical consumable components in the CMP process. One is the liquid slurry. The slurry's composition must typically be altered, with special formulations produced for the particular type of substrate being polished. Some substrates, for example, require an alkaline pH to be activated for polishing, while other substrates require an acid environment. Still other substrates respond best to silica abrasives, while others require alumina or titanium abrasive particles. The second critical consumable component in the CMP process is the polishing pad. It must be very flat, uniform across its entire surface and have the right combination of stiffness and compressibility to minimize effects like dishing and erosion. Traditional thinking considers it important that the pad be resistant to the chemical nature of the slurry so as not to decompose during polishing. A third critical consumable component in the CMP process is the carrier film. The carrier film attaches the wafer to its rotating holder, must have an adequately flat and uniform in its thickness, must have an adhesive that will hold it tightly to the carrier but not too tightly to the wafer, all while being immune to the chemical environment in which it works.

As noted above, the degradation of the polishing pad material due to the chemically aggressive nature of the polishing slurry has traditionally been considered problematic. Thus, slurry chemistries and pad compositions resulting in the decomposition of the pad have hitherto been avoided, because such changes would cause the polishing properties of the pad to change drastically as the polishing process progresses, especially during initial exposure of the pad to the slurry. Rapidly changing polishing properties are considered undesirable because the user's control of the polishing effect on the wafer is lost.

To address this problem, a technique called "seasoning" has been widely adopted. Seasoning involves exposing the pad to a conditioning-polishing environment. The pad is attached to a plate, and in the presence of a conditioning slurry, a conditioning ring is used to condition the pad. During this conditioning process, a force is applied to the conditioning ring that mechanically forces the slurry into the pad. The pad is thereby seasoned or conditioned for actual semiconductor wafer processing. While this traditional seasoning technique is somewhat helpful, these prior art processes still suffer from certain disadvantages. For example, even after a pad is conventionally seasoned as mentioned above, the pad's properties can continue to be transformed, thereby affecting the quality of the wafer's polished surface.

Accordingly, what is needed in the art is a polishing pad that does not suffer from the disadvantages associated with the prior art processes.

SUMMARY OF THE INVENTION

To address the deficiencies of the prior art, the present invention, in one embodiment, provides a polishing pad comprising a polishing body that includes a thermoplastic polymer. The thermoplastic polymer contains a precursor slurry modifier. When the polymer decomposes in the presence of a polishing slurry, the precursor slurry modifier is released to the polishing slurry to form a slurry modifier.

In another embodiment the present invention provides a method for the in situ delivery of a slurry modifier during chemical mechanical polishing of a semiconductor wafer. The method comprises providing a polishing pad comprising a polishing body that includes a thermoplastic polymer. The thermoplastic polymer contains a precursor slurry modifier. The method further comprises adding a polishing slurry and then decomposing the thermoplastic polymer in the presence of the polishing slurry. This releases the precursor slurry modifier to the polishing slurry to form a slurry modifier.

Yet another embodiment provides a polishing apparatus comprising a mechanically driven carrier head, a polishing platen, with the carrier head being positionable against the polishing platen to impart a polishing force against the polishing platen, and the above-mentioned polishing pad attached to the polishing platen.

The foregoing has outlined preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention.

BRIEF DESCRIPTION OF THE DRAWINGS

For a more complete understanding of the invention, reference is now made to the following descriptions taken in conjunction with the accompanying drawing, in which.

DETAILED DESCRIPTION

Figure 1:
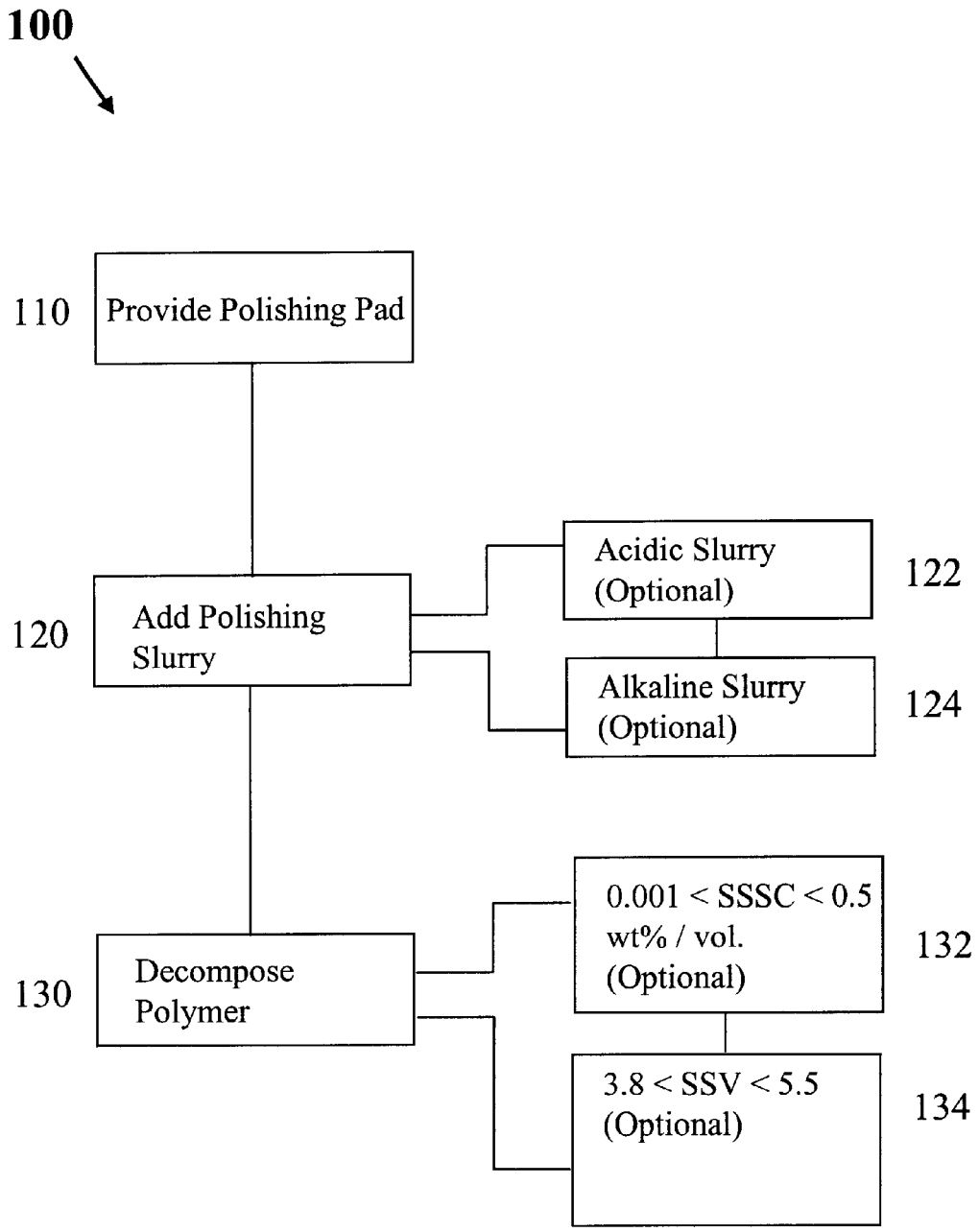
FIG. 1 illustrates a method for preparing a polishing pad according to the present invention.

The present invention recognizes the desirability of leveraging well-controlled pad transformation processes into a means of controlling and optimizing Chemical-Mechanical polishing. This, in turn, allows previously unusable, but highly desirable materials, to be used as polishing pads, with corresponding improvements in polishing activity, performance stability and cost.

During CMP of semiconductor wafers, a rotating polishing pad causes polishing slurry, located at an interface between the pad and the wafer, to rotate. The rotating slurry applies a shearing force to thereby remove material from the surface of the wafer. The removal rate and degree of planarization during CMP can be improved by increasing the momentum coupling between the polishing pad and the slurry. The present invention recognizes that the viscosity of the slurry at the interface can be increased by releasing slurry modifiers from the pad into the slurry. As the slurry's viscosity is increased, due to the presence of modifiers, there is increased momentum coupling between the slurry and pad, resulting in a faster and more uniform removal rate.

The in situ delivery of such slurry modifiers presents several heretofor unrecognized advantages over conventional processes that include modifiers in a stock slurry solution. For example, slurry modifiers that are pre-mixed into a stock slurry solution before use, may coalesce and precipitate. Moreover, certain slurry modifiers, such as those containing diamines, can oxidize on exposure to air, thus changing the composition of the slurry. In contrast, by releasing slurry modifiers from the pad at the time of CMP, the modifiers are introduced into the slurry at the pad-wafer interface as needed, thereby minimizing the risk of modifying the pre-existing chemical properties of the slurry. This, in turn, allows the continued use of conventional slurry compositions. Alternatively, such slurry modifiers could be delivered directly to the point of use, i.e., the pad-wafer interface. This, however, requires costly modifications to a CMP of apparatus, such as that described by U.S. Pat. No. 6,048,256, to Obeng et al., and incorporated herein by reference. In the present invention, by delivering the modifiers via the polishing pad itself, alterations to both the CMP apparatus and stock slurry solution are avoided.

In one aspect, the present invention provides a polishing pad comprising a polishing body that includes a thermoplastic polymer, wherein the polymer contains a precursor slurry modifier. The polymer decomposes in the presence of a polishing slurry to release the precursor slurry to the polishing slurry to form a slurry modifier. As further explained below, the composition of the precursor-containing polymer and the slurry are important factors in determining the composition and release of the slurry modifier.

For instance, polymers that are thermoset polymers are inappropriate choices for inclusion in the polishing body. Commercially available polishing pads, for example, the IC-1000 polishing pad (Rodel, Phoenix, Ariz.), includes a polishing body comprising a thermoset polyurethane polymer, and thus are not appropriate. For the purposes of the present invention, thermoset polymers are defined as those polymers that have gone through a partial curing process, for example from about 50 to about 90% of complete cross-linking. If such a thermoset polymer is heated, the curing process continues, and upon cooling, the polymer's chemical and mechanical properties relevant to CMP are irreversibly altered. In contrast, thermoplastic polymers, such as those used in the present invention, have gone through a complete curing process, for example about 95% to about 100% of the cross linking process. Such thermoplastic polymers thereby retain their chemical and mechanical properties after heating and cooling cycles. As further explained below, because the decomposition of thermoset and thermoplastic polymers are substantially different, the former is inappropriate for use as polishing pad materials in the present invention.

The decomposition of polymer comprising the polishing body of the present invention preferably involves a two-step process. First, the reactive species initiating decomposition, must permeate into the bulk of the polymer matrix. Thermoset polymers, because they are partially cured, are substantially more permeable to the reactive species, as compared to thermoplastic polymers. Second, the reactive species must then find a functional group within the polymer matrix capable of reacting with the species and thereby initiate decomposition via depolymerization. Because thermoset polymers are partially cured, there are substantially more functional groups available for reacting with the reactive species, as compared to thermoplastic polymers. From the above considerations, it follows that thermoset polymers decompose at inappropriate substantially faster rates than thermoplastic polymers. Thermoset polymers are therefore poor choices for the in situ delivery of slurry modifiers according to the principles of the present invention because their rate of decomposition cannot be controlled under the conditions used for CMP.

Examples of reactive species to initiate decomposition include nucleophiles, such as hydroxide ion ($OH^-$) or electrophiles, such as hydrogen ion ($H^+$). Such preferred reactive species have the advantage of already being present in conventional polishing slurries. The concentration of the reactive species, however, will be defined by the polishing slurry conditions required to achieve an efficient wafer polishing environment. For instance, for the polishing of silicon, polysilicon or dielectric containing wafers, basic buffers suitable for inclusion in the polishing slurry has a pH of greater than about 7.0, and preferably ranging from about 10.0 to about 12.0. Alternately, for the polishing of metals layers on the wafer, such as W or Cu, an acidic slurry polishing medium having a pH of less than about 7.0, and preferably ranging from about 2 to about 3.5,is used.

In contrast to thermoset polymers, the thermoplastic polymers of the present invention have rates of decomposition so as to allow a precursor slurry modifier, contained in the polymer, to be released to the polishing slurry to form a slurry modifier. That is, the decomposition of the thermoplastic polymer during CMP defines the amount of slurry modifier ultimately released into the polishing slurry. For example, to provide effective momentum coupling, the slurry modifier in certain embodiments of the present invention ranges from about 0.001 to about 0.5 weight percent per volume of slurry, and preferably equals about 0.01 weight percent per volume.

The present invention envisions any thermoplastic polymer material capable of delivering a slurry modifier via the polymer's decomposition during CMP as suitable material. In certain preferred embodiments, however, the thermoplastic polymer may be a condensation polymer. In such polymers, water molecules are split out during the condensation process, with the resulting polymer containing functional groups that can serve as initiation sites for decomposition.

For example, in certain preferred embodiments, the thermoplastic polymer includes ethylene vinyl acetate (EVA). Alternatively, the thermoplastic polymer includes EVA co-blended with polyethylene. In yet other advantageous embodiments, the thermoplastic polymer includes poly (vinyl alcohol). The precursor slurry modifiers include the alcohol moieties contained in such Ad polymers. And, on exposure to a polishing slurry, for example, conventional slurries used for silica or metal polishing, the slurry modifiers includes reaction byproduct alcohols such as: dialcohols, vinyl alcohols, or short ($C \leqq 8$) or long carbon chain ($C>8$) polyalcohols. In still other embodiments, the thermoplastic polymer includes cyclodextrin, which on decomposition releases a slurry modifier that includes dextrin. In alternative embodiments, the thermoplastic polymer includes cellulose acetate butyrate, which on decomposition releases a slurry modifier that includes cellulose.

In certain preferred embodiments, the thermoplastic polymer, including for example, any of the above-mentioned polymers, is free of filler material. Fillers, such as calcium or magnesium salts, are added to conventional polishing pad materials to reduce costs and reinforce the pad material's hardness. In the present invention, however, such filler materials could complex with the by-products of decomposition, i.e., the precursor slurry modifiers, thereby producing a deleterious reduction in the release of slurry modifier. Moreover, such complexes may precipitate, thereby deleteriously altering the polishing characteristics of the polishing slurry. Thus, for certain embodiments of the present invention, the thermoplastic polymer includes polyurethane that is free of filler material. The decomposition, i.e., de-condensation, of the polyurethane-containing polishing body, results in the release of slurry modifiers including for example, dialcohols, diamines, polyalcohols or isocyanate.

The polishing slurry may include any conventional slurry solution, provided that reactive species are sufficiently present to initiate decomposition of the polishing pad, such as acid or base, as discussed above. An aqueous slurry medium, for example, may include additives to further simulate the polishing process. For example, the additives may be oxidants that can be used in a polishing slurry. In other embodiments, the additive may be an abrasive, such as silica or alumina, although other abrasives known to one skilled in the art may be used as well. In still other embodiments, the additive may be an organic amine, such as ethanol amine.

FIG. 1 illustrates another embodiment of the present invention, a method 100 for the in situ delivery of a slurry modifier during chemical-mechanical polishing of a semiconductor wafer. The method 100 comprises providing, at step 110, a polishing pad comprising a polishing body that includes a thermoplastic polymer containing a precursor slurry modifier. The thermoplastic polymer may be, for example, any of the polymers, and containing the precursor slurry modifiers, as discussed above. In certain preferred embodiments, the polishing pad is provided as part of a conventional CMP apparatus.

Next, at step 120, a polishing slurry, such as a conventional polishing slurry, is added. The addition of polishing slurry may be accomplished by any conventional technique sufficient to provide slurry containing the reactive species discussed above at an interface between the polishing pad and the wafer. For example, in certain advantageous embodiments, the added polishing slurry 122 is acidic having a pH of less than about 7, and preferably ranging from about 2 to about 3.5. In other advantageous embodiments, the added polishing slurry 124 is alkaline having a pH of greater than about 7, and preferably ranging from about 10.0 to 12.0.

Next, at step 130, the thermoplastic polymer is decomposed in the presence of the slurry to release the precursor slurry modifier to the polishing slurry to form a slurry modifier. The polymer should decompose at a rate sufficient to provide a steady state concentration of the slurry modifier so as to improve momentum coupling, as discussed above. The rate of polymer decomposition 132 during CMP may result in the production of slurry modifier at rates ranging, for example, from about 0.001 to about 2 $\mu$mol/min, preferably from about 0.1 to about 1 $\mu$mol/min, a more preferably, from about 0.2 to about 0.5 $\mu$mol/min. In certain embodiments, the rate of decomposition 132 provides steady state slurry concentrations (SSSC) ranges from about 0.001 to about 0.5 weight percent per volume of the polishing slurry, and preferably equal to about 0.01 weight percent. In yet other preferred embodiments, the above concentrations refer specifically to the concentrations of slurry modifier at an interface between the polishing body and the wafer.

In alternative embodiments of the present invention, the polymer decomposes at a rate sufficient to modify a slurry solution viscosity (SSV) and thus improve momentum coupling. For example, in certain preferred embodiments, the rate of decomposition 134 provides SSV ranging from about 3.8 to about 5.5 cP, and preferably equal to about 4.0 cP. In yet other preferred embodiments, the above viscosities refer to the viscosity of the slurry modifier at an interface between the polishing body and the wafer. The above-mentioned ranges and preferred concentrations and viscosities, however, could vary over broader values than that cited above, depending on the composition of slurry, polishing pad, and other polishing conditions, well known to those of ordinary skill in the art.

Figure 2:
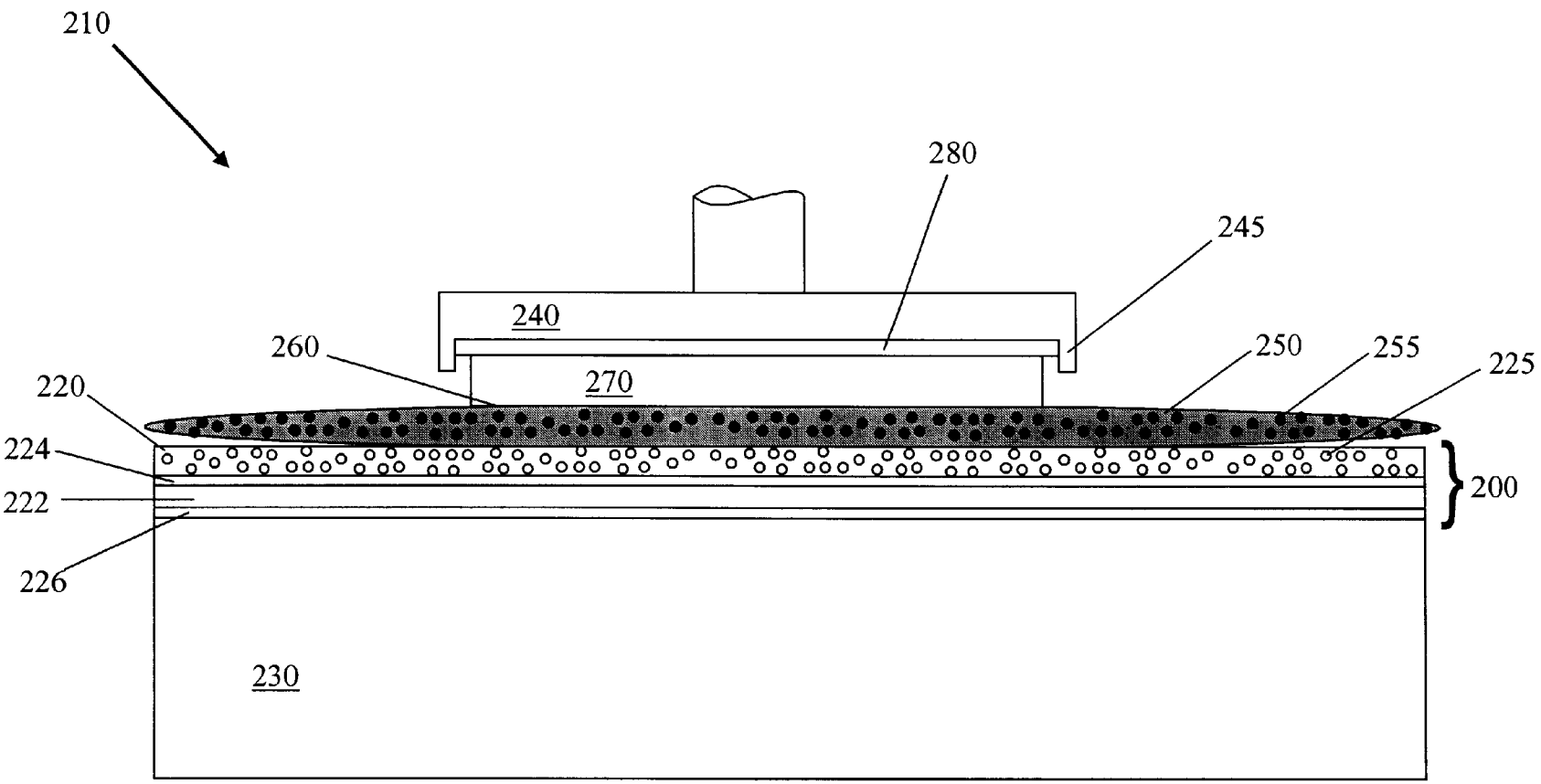
FIG. 2 illustrates a polishing apparatus, including a polishing pad comprising a thermoplastic polymer made according to the present invention.

Polishing pads fabricated from the polishing body 200 of the present invention may be employed in a variety of CMP polishing apparatus 210, one embodiment of which is displayed in FIG. 2. The polishing body 200, comprises a thermoplastic polymer 220 of the present invention, where the thermoplastic polymer 220 forms a polishing surface located over an optional base pad 222. Optionally, a first adhesive material 224, such as acrylate-based, silicone-based, epoxy or other materials well known to those skilled in the art, may be used to couple the base pad 222 to the thermoplastic polymer 220. The resulting polishing pads may also have a second conventional adhesive material 226 applied to the polishing platen 230. The polishing pad may then be cleaned and packaged until employed for use.

With continuing reference to FIG. 2, the polishing body 200 may then be employed in a variety of CMP processes by incorporating it into the polishing apparatus 210. The polishing apparatus 210 typically includes a conventional mechanically driven carrier head 240, a conventional carrier ring 245, the conventional polishing platen 230, and the polishing pad attached to the polishing platen 230. The polishing pad comprises the polishing body 200 that includes the thermoplastic polymer 220 of the present invention, for example, any of the above-described polymers. Also, as discussed above, the polymer 220 contains a precursor slurry modifier 225. In the presence of an appropriate conventional polishing slurry mixture 250 dispensed on the polishing body 200, the polymer 240 slowly decomposes. Decomposition results in the release of the precursor slurry modifier 225 to form a slurry modifier 255 at an interface 260 between the polishing body 200 and a semiconductor wafer 270.

The polishing body 200 may be attached to the polishing platen 230 by using the second adhesive 226, if so desired. The substrate to be polished 270, typically a semiconductor wafer, may be attached to the carrier ring 245 with the aid of a third conventional adhesive material 280. The carrier head 240 is then positioned close to the polishing platen 230 to impart a polishing force to the interface 260 containing the slurry modifier 255.

With continuing reference to FIG. 2, in such polishing processes, a substrate wafer 270 may be polished by positioning the wafer having at least one layer, on to the above-described polishing apparatus 210. Polishing is facilitated via enhanced momentum coupling between the rotating polishing body 200 and the slurry 250 containing the slurry modifier 255, at the interface 260 between the body 200 and wafer 270. In one embodiment, the substrate wafer 270 has at least one layer of material that is a metal layer. In particular embodiments, the metal layer may be Cu or W. In another embodiment, there may be silicon, polysilicon or dielectric material located on the substrate wafer 270. Thermoplastic polymers 220 of the present inventions are particularly suited for polishing in shallow trench isolation (STI), interlevel dielectrics, and metal interconnects in integrated circuit fabrication or other fabrication techniques where large areas of field oxide, other dielectrics or metal must be removed from the wafer 270 to produce a planar surface prior to subsequent processing. The thermoplastic polymers 220 of the present inventions are also desirable for polishing metalization materials such as W, Ti, Cu, Al, and other metals as well as nitrides or barrier materials such as $Si_3N_4$, TaN, TiN.

EXAMPLES

A model system was used to examine the efficacy of slurry modifiers. A polishing pad was fabricated from a polymer comprising polyethylene foam (HS900, from Dow Chemicals), and used in polishing thermally grown silicon dioxide. Those skilled in the art know that HS900 is an inert polymer that does not decompose in acids and CMP slurries. To simulate the effect of slurry modifiers on the polishing environment, ethylene glycol was added to a commercial polishing slurry (Klebosol 1501 from Rodel). The ethylene glycol was added in concentration ranging from 0.001 to 25 percent volume per volume of slurry. The experiment was performed using a conventional CMP tester (Model PMT-A, from CETR, Inc., Campbell, Calif.), operated with a down force of 3 psi and table speed of 200 rpm. The CMP tester was equipped with both a coefficient of friction and an acoustic signal detector.

Figure 3:
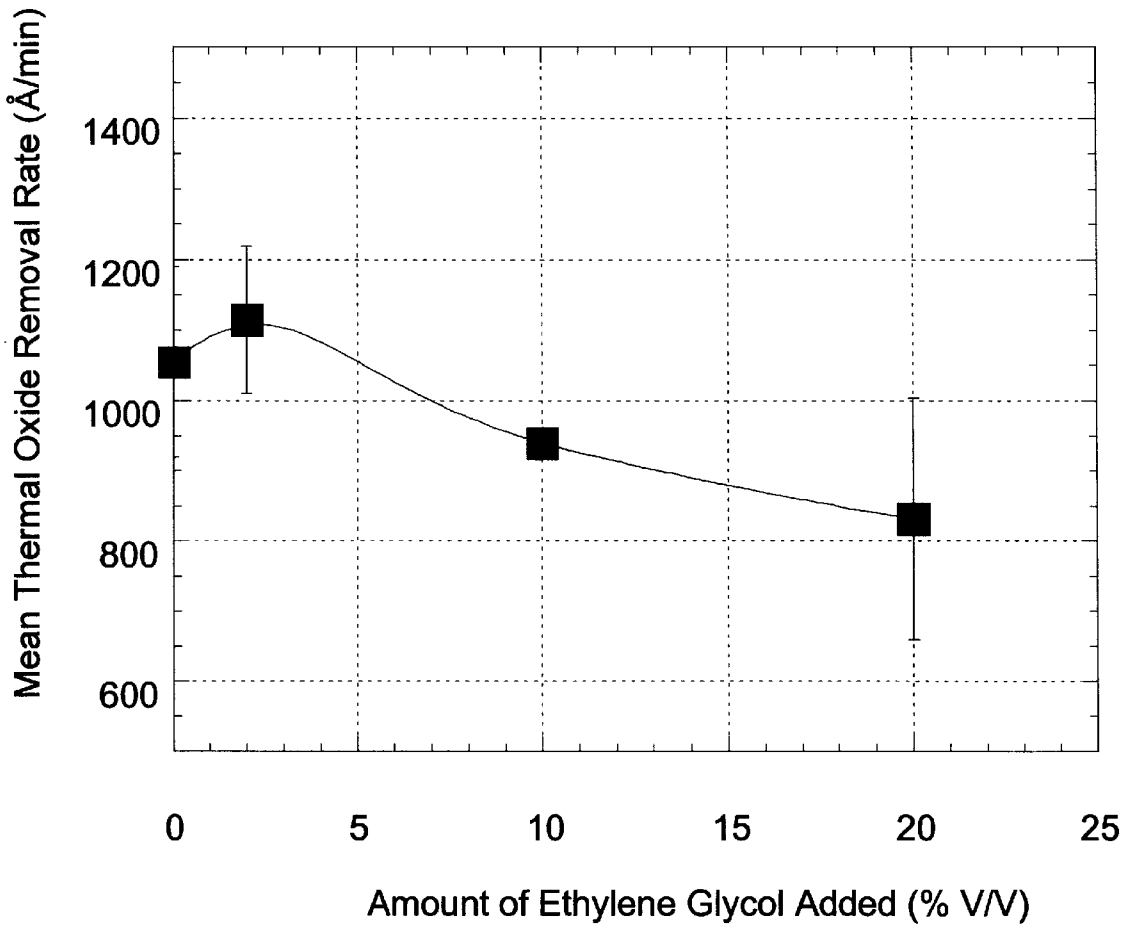
FIG. 3 illustrates the relationship between thermal oxide removal rate and ethylene glycol concentration during CMP in a model system to simulate the slurry modifiers of the present invention.
Figure 4:
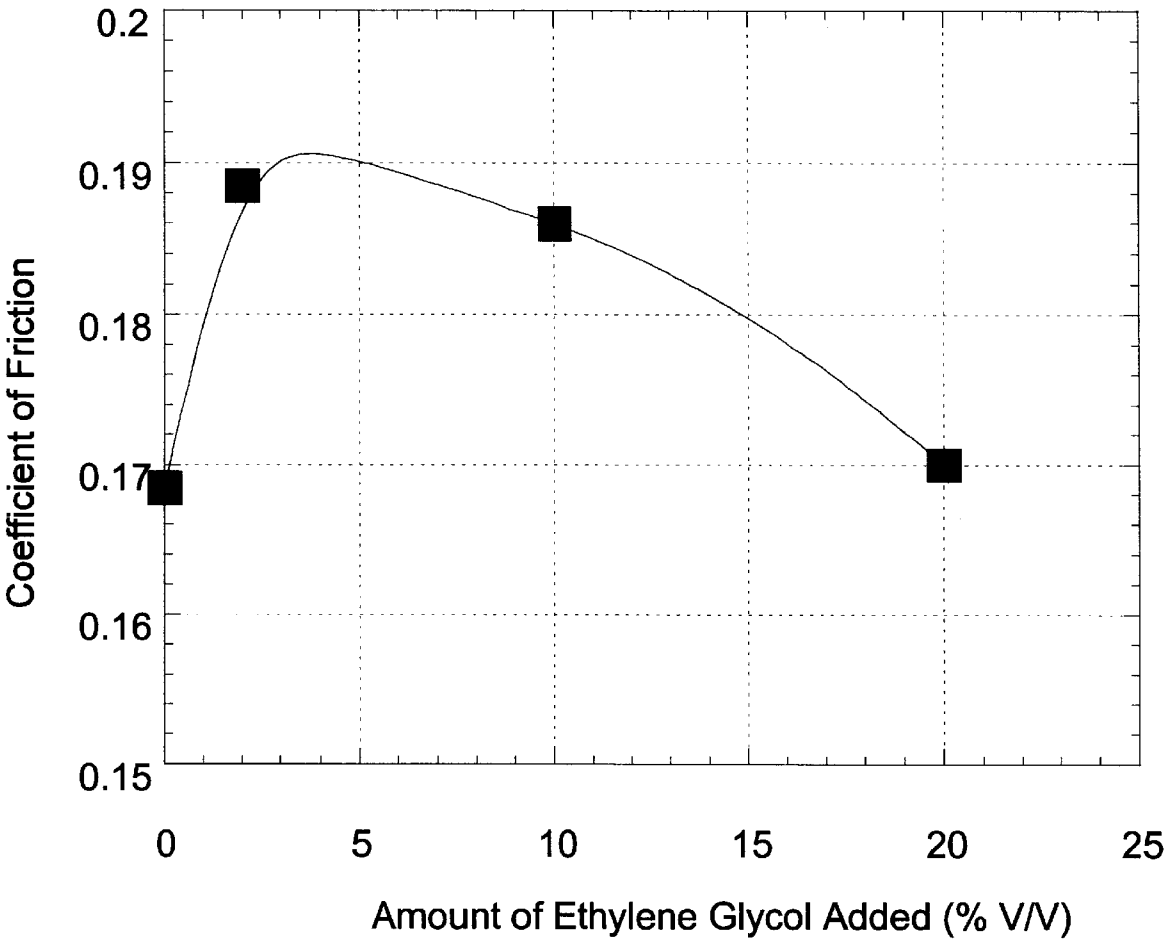
FIG. 4 illustrates the relationship between coefficient of friction and ethylene glycol concentration during CMP in a model system to simulate the slurry modifiers of the present invention.

FIG. 3 shows the oxide removal rate as a function of the concentration of ethylene glycol in the polishing slurry. The oxide removal rate (i.e., polishing rate) increased with increasing additive concentration, up to about 2 percent volume per volume. Above that concentration, the removal rate decreased. As illustrated in FIG. 4, a similar trend was observed in the evolution of the coefficient of friction with ethylene glycol concentration. As indicated by the variation in error bars, in FIG. 3, the uniformity of the polishing rate depends on the concentration of ethylene glycol. Thus, the ethylene glycol concentration providing optimal uniformity does not necessarily coincide with the ethylene glycol concentration providing the optimal removal rate.

Although the present invention has been described in detail, those skilled in the art should understand that they can make various changes, substitutions and alterations herein without departing from the spirit and scope of the invention.

What is claimed is:

1. A polishing pad comprising:

a polishing body including a thermoplastic polymer containing a precursor slurry modifier wherein said polymer decomposes in the presence of a polishing slurry to release said precursor slurry modifier to said polishing slurry to form a slurry modifier.

2. The polishing pad as recited in claim 1 wherein said thermoplastic polymer decomposes when said polishing slurry has a pH of less than about 7.

3. The polishing pad as recited in claim 1 wherein said thermoplastic polymer decomposes when said polishing slurry has a pH ranging from about 2 to about 3.5.

4. The polishing pad as recited in claim 1 wherein said thermoplastic polymer decomposes when said polishing slurry has a pH of greater than about 7.

5. The polishing pad as recited in claim 1 wherein said thermoplastic polymer decomposes when said polishing slurry has a pH ranging from about 10.0 to about 12.0.

6. The polishing pad as recited in claim 1 wherein a steady state concentration of said modifier ranges from about 0.001 to about 0.5 weight percent per volume of said polishing slurry.

7. The polishing pad as recited in claim 1 wherein a steady state concentration of said modifier equals about 0.01 weight percent per volume of said polishing slurry.

8. The polishing pad as recited in claim 1 wherein said thermoplastic polymer includes Ethylene Vinyl Acetate.

9. The polishing pad as recited in claim 1 wherein said thermoplastic polymer includes Ethylene Vinyl Acetate co-blended with Polyethylene.

10. The polishing pad as recited in claim 1 wherein said thermoplastic polymer includes Poly(Vinyl Alcohol).

11. The polishing pad as recited in claim 1 wherein said thermoplastic polymer includes Cyclodextrin.

12. The polishing pad as recited in claim 1 wherein said thermoplastic polymer includes Cellulose Acetate Butyrate.

13. The polishing pad as recited in claim 1 wherein said thermoplastic polymer is free of filler material.

14. The polishing pad as recited in claim 13 wherein said thermoplastic polymer includes Polyurethane.

15. A method for the in situ delivery of a slurry modifier during chemical mechanical polishing of a semiconductor wafer, comprising:

providing a polishing pad comprising a polishing body that includes a thermoplastic polymer containing a precursor slurry modifier;

adding a polishing slurry;

decomposing said thermoplastic polymer in the presence of said polishing slurry to release said precursor slurry modifier to said polishing slurry to form a slurry modifier.

16. The method as recited in claim 15 wherein said decomposing occurs when said polishing slurry has a pH of less than about 7.

17. The method as recited in claim 15 wherein said decomposing occurs when said polishing slurry has a pH ranging from about 2 to about 3.5.

18. The method as recited in claim 15 wherein said decomposing occurs when said polishing slurry has a pH of greater than about 7.

19. The method as recited in claim 15 wherein said decomposing occurs when said polishing slurry has a pH ranging from about 10.0 to about 12.0.

20. The method as recited in claim 15 wherein said decomposing occurs at a rate sufficient to provide a steady state concentration of said slurry modifier ranging from about 0.001 to about 0.5 weight percent per volume of said polishing slurry.

21. The method as recited in claim 15 wherein said decomposing occurs at a rate sufficient to provide a steady state concentration of said modifier equal to about 0.01 weight percent per volume of said polishing slurry at said interface.

22. The method as recited in claim 15 wherein said decomposing occurs at a rate sufficient to provide a steady state solution viscosity of said polishing slurry ranging from about 3.8 to about 5.5 cP.

23. The method as recited in claim 15 wherein said decomposing occurs at a rate sufficient to provide a steady state solution viscosity said polishing slurry equal to about 4.0 cP.

24. A polishing apparatus comprising:

a mechanically driven carrier head;

a polishing platen, said carrier head being positionable against said polishing platen to impart a polishing force against said polishing platen; and a polishing pad attached to said polishing platen and including a polishing body comprising a thermoplastic polymer containing a precursor slurry modifier wherein said polymer decomposes in the presence of a polishing slurry to release said precursor slurry modifier to form a slurry modifier at an interface between said polishing body and a semiconductor wafer.

25. The polishing apparatus as recited in claim 24 wherein said thermoplastic polymer includes Ethylene Vinyl Acetate.

26. The polishing apparatus as recited in claim 24 wherein said thermoplastic polymer includes Ethylene Vinyl Acetate co-blended with Polyethylene.

27. The polishing apparatus as recited in claim 24 wherein said thermoplastic polymer includes Poly(Vinyl Alcohol).

28. The polishing apparatus as recited in claim 24 wherein said thermoplastic polymer includes Cyclodextrin.

29. The polishing apparatus as recited in claim 24 wherein said thermoplastic polymer includes Cellulose Acetate Butyrate.

30. The polishing apparatus as recited in claim 24 wherein said thermoplastic polymer is free of filler material.

31. The polishing apparatus as recited in claim 30 wherein said thermoplastic polymer includes Polyurethane.

* * * * *